US007275294B1

(12) United States Patent
Okuley

(10) Patent No.: US 7,275,294 B1
(45) Date of Patent: Oct. 2, 2007

(54) MAGNETIC PARTS HOLDER

(75) Inventor: David K. Okuley, Wapakoneta, OH (US)

(73) Assignee: Honda Motor Co., Ltd., Tokyo (JP)

( * ) Notice: Subject to any disclaimer, the term of this patent is extended or adjusted under 35 U.S.C. 154(b) by 496 days.

(21) Appl. No.: 10/647,954

(22) Filed: Aug. 26, 2003

(51) Int. Cl.
*B25B 27/14* (2006.01)

(52) U.S. Cl. ..... 29/281.1; 29/464; 269/8; 248/683; 414/797.1

(58) Field of Classification Search ..... 29/281.1, 29/464, 719, 744, 810; 269/8; 279/128; 335/285, 288; 248/683; 291/88, 65.5; 414/793.2, 414/797.1
See application file for complete search history.

(56) References Cited

U.S. PATENT DOCUMENTS

| | | | | |
|---|---|---|---|---|
| 766,201 | A | 8/1904 | Sponsel | |
| 2,187,240 | A | 1/1937 | Karasick | |
| 2,160,405 | A | 5/1939 | Mallalieu | |
| 2,286,238 | A | 6/1942 | Simmons | |
| 2,359,293 | A | 8/1942 | Beechlyn | |
| 2,400,314 | A | 7/1944 | Qbecny | |
| 2,435,735 | A | 2/1948 | Briggs | |
| 2,503,467 | A * | 4/1950 | Blind | 294/65.5 |
| 2,619,778 | A * | 12/1952 | Klatt | 451/117 |
| 2,976,075 | A * | 3/1961 | Budreck | 294/65.5 |
| 3,262,232 | A | 9/1963 | Hilbrunner | |
| 3,116,571 | A | 1/1964 | Riggan et al. | |
| 2,754,313 | A | 8/1973 | McCullock | |
| 4,153,151 | A | 5/1979 | Kulberg et al. | |
| 4,832,176 | A | 5/1989 | Okuma et al. | |
| 4,896,638 | A | 1/1990 | Shepley | |
| 5,355,572 | A | 10/1994 | Kammeraad et al. | |
| 6,467,154 | B1 | 10/2002 | Beggs | |
| 6,545,579 | B1 * | 4/2003 | Dimke et al. | 335/285 |
| 6,824,657 | B1 * | 11/2004 | Fischer | 204/297.02 |

FOREIGN PATENT DOCUMENTS

| | | | |
|---|---|---|---|
| WO | 00/41475 | * | 7/2000 |

* cited by examiner

*Primary Examiner*—Jermie E. Cozart
(74) *Attorney, Agent, or Firm*—Rankin, Hill, Porter & Clark LLP; Vincent Ciamacco

(57) ABSTRACT

A parts holding device that includes a holder with a row of spaced-apart cavities, within which parts may be disposed. A bar containing a plurality of spaced-apart permanent magnets is movably mounted to the holder and is disposed parallel to the row of the cavities. The bar is movable in the direction of the row of the cavities between first and second positions. When the bar is in the first position, the magnets are aligned with the cavities and the magnetic attraction forces generated by the magnets hold the parts in the cavities, and when the bar is in the second position, the magnets are not aligned with the cavities and the magnetic attraction forces generated by the magnets do not hold the parts in the cavities. The parts holding device is connected to a movable mounting structure for movement therewith. The bar is biased to the first position and is moved to the second position by movement of the bar against a cam surface.

19 Claims, 7 Drawing Sheets

MAGNETIC PARTS HOLDER

BACKGROUND OF THE INVENTION

The present invention generally relates to holding devices and more specifically to devices for holding parts during the movement of the parts to an installing device.

Holding devices are commonly used in manufacturing operations to hold parts as they are being moved from a parts feeder to a parts installing device. For example, during the manufacture of internal combustion engines, valve guide inserts are moved from a valve guide feeder to a press unit that inserts or presses the valve guide inserts into valve guide bores of a cylinder head. An automated delivery system is typically provided for moving the valve guide inserts from the valve guide feeder to the press unit. An example of such an automated delivery system is disclosed in U.S. Pat. No. 4,832,176 to Okuma et al., which is assigned to the assignee of the present invention and is hereby incorporated by reference. In the Okuma et al. patent, the delivery system includes a parts supplying device that moves valve guide inserts from a parts distributing device to a parts installing device (press). The parts supply device includes a holder for holding the valve guide inserts as they are being moved from the parts distributing device to the press.

The holder of the Okuma et al. patent includes a plurality of holes for receiving the valve guide inserts. A plurality of other holes or bores are disposed perpendicular to the receiving holes and are in communication with radially outer portions of the receiving holes. Spring-biased lock pins are disposed in the bores and are movable between holding and release positions. When valve guide inserts from the parts distributing device are deposited in the receiving holes of the holder, the lock pins are located in their release positions and do not obstruct the movement of the valve guide inserts into the receiving holes. When the holder moves away from the parts distributing device, a cam member moves the lock pins to their holding positions, which causes the lock pins to engage the valve guide inserts, thereby preventing the valve guide inserts from moving or falling out of the receiving holes. When the holder arrives at the parts installing device, the cam member moves the lock pins back to their release positions, which causes the lock pins to disengage from the valve guide inserts, thereby permitting the valve guide inserts to be transferred to the press.

It has been observed that after a period of use, parts holders having a construction similar to the holder of the Okuma et al. patent will, on occasion, malfunction and drop the parts they are holding. Such malfunctioning can be attributed to the accumulation of debris (such as metal particles from the parts) in the receiving holes and bores of the holders. This accumulation of debris interferes with the operation of the locking pins and prevents them from properly holding the parts in the receiving holes.

Based on the foregoing, there is a need in the art for a holding device for holding parts, such as valve guide inserts, during the movement of the parts to an installing device, such as a press unit, wherein the holding device is not susceptible to malfunctioning due to the accumulation of debris. The present invention is directed to such a holding device and to a supply system utilizing such a holding device, as well as to a method of moving parts.

SUMMARY OF THE INVENTION

In accordance with the present invention, a holding device is provided for holding a plurality of ferromagnetic parts.

The holding device includes a holder defining a plurality of cavities within which the parts may be disposed. The cavities are spaced apart and arranged in a row. A bar is movably mounted to the holder and is disposed parallel to the row of the cavities. The bar includes a plurality of spaced-apart magnetic bodies arranged in a row and is movable in the direction of the row of the cavities between first and second positions. When the parts are disposed in the cavities and the bar is in the first position, the magnetic bodies are aligned with the cavities and the magnetic attraction forces generated by the magnetic bodies hold the parts in the cavities. When the parts are disposed in the cavities and the bar is in the second position, the magnetic bodies are not aligned with the cavities and the magnetic attraction forces generated by the magnetic bodies do not hold the parts in the cavities.

The holding device of the present invention may be part of a supply system for supplying the ferromagnetic parts to an installing device. The holding device is connected to a mounting structure that is movable between a return position and a load position. At least one actuation structure is positioned such that an end portion of the bar of the holding device contacts the actuation structure during the movement of the mounting structure between the return position and the load position. The contact between the actuation structure and the end portion of the bar moves the bar to the second position.

Also provided in accordance with the present invention is a method of moving ferromagnetic parts to an installing device. In accordance with the method, a holder defining a plurality of cavities is provided. A plurality of magnetic bodies is also provided. The parts are placed in the cavities of the holder, respectively. The magnetic bodies are moved so as to be in alignment with the parts, respectively, thereby causing the parts to be held in the cavities. The holder is moved to the installing device and the magnetic bodies are moved so as to not be in alignment with the parts, thereby permitting the parts to be removed from the cavities. The parts are then moved from the cavities to the installing device.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
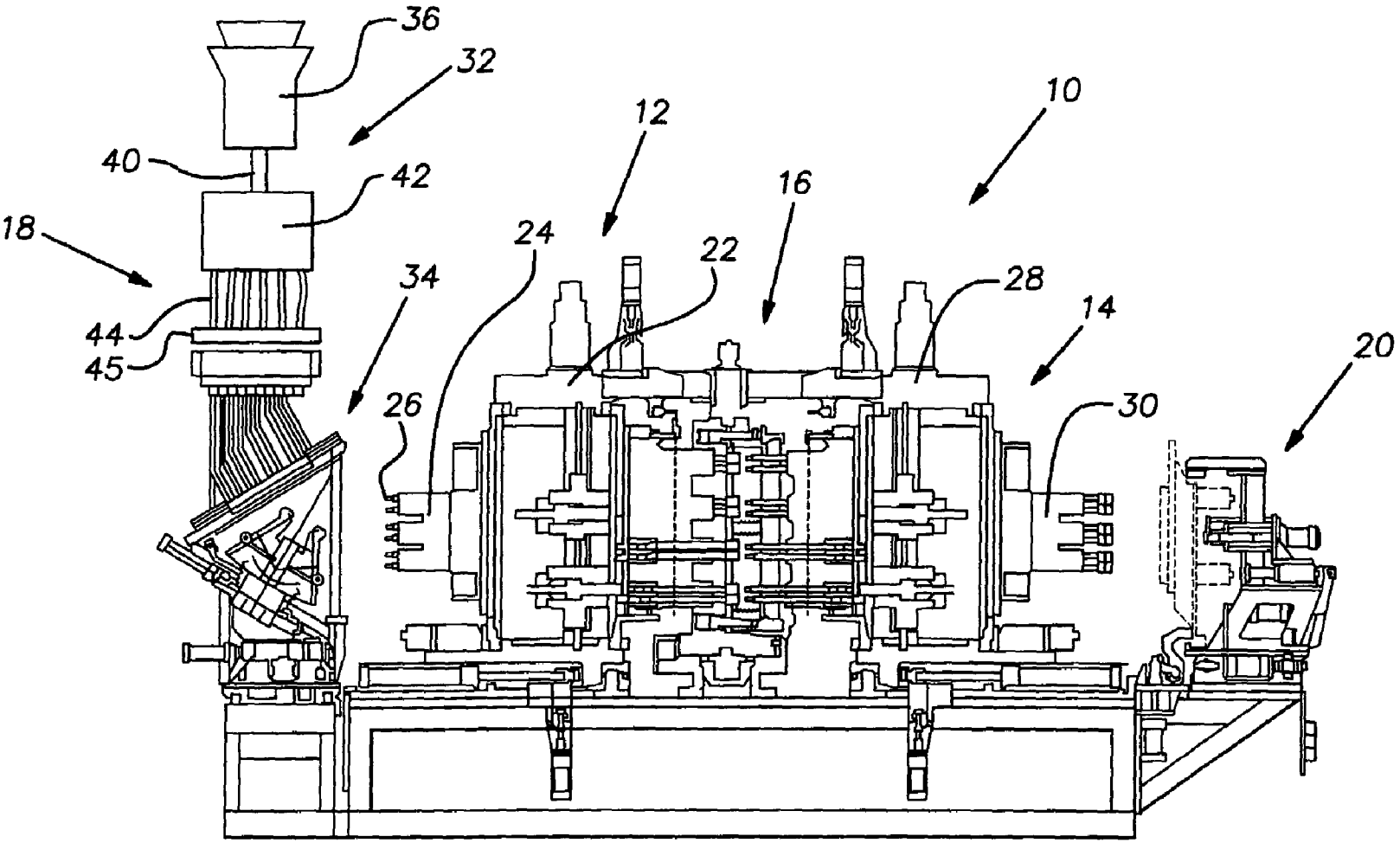
FIG. 1 shows a side elevational view of a cylinder head pressing system.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

In the description that follows, the terms "top", "bottom", "vertical", "lateral", "rearward", "forward", "horizontal", "upwardly", "downwardly", "below", "above", etc. typically relate to the positions of devices, structures, components, etc. as they are shown in the relevant drawing(s). These positions, however, may not necessarily be the positions of the devices, structures, components, etc. during actual use of the invention. Accordingly, the foregoing terms should be viewed more as relative terms, rather than absolute terms.

The present invention is directed to a holding device for holding parts during the movement of the parts from a distribution system to an installing device. The holding device is suited for use in an engine assembly operation, wherein the holding device holds valve guide inserts during the movement of the valve guide inserts from a distribution system to a press unit that presses the valve guide inserts into valve guide bores of a cylinder head for an internal combustion engine. The holding device of the present invention is more specifically suited for use in an engine assembly operation, such as the cylinder head pressing system 10 shown in FIG. 1. The cylinder head pressing system 10 comprises a portion of an engine manufacturing operation located in a manufacturing facility. The cylinder head pressing system 10 generally includes a guide press unit 12, a seat press unit 14, a turning jig 16, a guide delivery system 18, and a seat delivery system 20.

The guide press unit 12 includes a main body or turret 22 that is rotatable about a central vertical axis. First, second, third and fourth presses extend outwardly from the turret 22 and are arranged so as to be disposed at 90° angles to each other. The first press (designated by reference numeral 24) is operable to insert a set of exhaust valve guide inserts into exhaust valve guide bores of a first type of cylinder head, and the second press (not shown) is operable to insert a set of intake valve guide inserts into intake valve guide bores of the first type of cylinder head. The third press (not shown) is operable to insert a set of exhaust valve guide inserts into exhaust valve guide bores of a second type of cylinder head, and the fourth press (not shown) is operable to insert a set of intake valve guide inserts into intake valve guide bores of the second type of cylinder head. The first press 24 and the other presses each include a plurality of vertically spaced-apart collets 26. The number of collets 26 is determined by the type of cylinder head the press is adapted for use on. For example, in the embodiment shown, the first type of cylinder head is for a V6 engine, wherein there are two cylinder heads, with three cylinders per cylinder head and four valves per cylinder, and the second type of cylinder head is for a four cylinder engine, wherein there is one cylinder head having four cylinders, with four valves per cylinder. Therefore, the first press 24 and the second press each have six collets 26, since six exhaust valve guide inserts and six intake valve guide inserts need to be inserted into each cylinder head for the V6 engine, whereas the third and fourth presses each have eight collets 26, since eight exhaust valve guide inserts and eight intake valve guide inserts need to be inserted into the lone cylinder head for the four cylinder engine.

In the embodiment of the invention shown and described herein, the cylinder head pressing system 10 operates to insert exhaust valve guide inserts and intake valve guide inserts into the first type of cylinder head, i.e., a cylinder head for a V6 engine. In such an operation, the third and fourth presses are not used. The operation of the cylinder head pressing system 10, however, can be quickly changed to insert exhaust valve guide inserts and intake valve guide inserts into the second type of cylinder head, i.e., a cylinder head for a four cylinder engine. The presence of the third and fourth presses, helps facilitate such a change in operation of the cylinder head pressing system 10.

The seat press unit 14 also includes a main body or turret 28 that is rotatable about a central vertical axis. Four presses 30 extend outwardly from the turret and are arranged so as to be disposed at 90° angles to each other. Each of the presses is operable to insert a set of exhaust or intake valve seats into intake or exhaust ports of a cylinder head. The seat press unit 14 is supplied with valve seats by the seat delivery system 20.

The turning jig 16 is disposed between the guide press unit 12 and the seat press unit 14 and is operable to hold a cylinder head when the valve guide inserts and valve seats are being installed by the guide press unit 12 and the seat press unit 14, respectively.

The guide delivery system 18 includes a distribution system 32 and a supply system 34. The distribution system 32 and the supply system 34 have a structure and function similar to the distribution and supply system shown in the Okuma et al. patent.

The distribution system 32 includes a first insert feeder 36 and a second insert feeder (not shown). The first insert feeder 36 is operable to feed exhaust valve guide inserts, while the second insert feeder is operable to feed intake valve guide inserts. The first insert feeder 36 and the second insert feeder are generally funnel-shaped and are connected by first tubes 40 and second tubes (not shown), respectively, to a first array mechanism 42 and a second array mechanism (not shown), respectively. The first array mechanism 42 is operable to produce arrays of exhaust valve guide inserts and the second array mechanism is operable to produce arrays of intake valve guide inserts. The first array mechanism 42 and the second array mechanism each include a frame (not shown) having a series of spaced apart grooves extending therethrough. Distribution plates (not shown) are disposed over the frames, respectively, and each include a plurality of staggered, spaced-apart openings that are in communication with the grooves. Distributors (not shown) are movable across the distribution plates, respectively, to move valve guide inserts through the openings and into the grooves. The grooves in the frame of the first array mechanism 42 are connected by first array tubes 44 to inlets of a series of passages extending through a fixed first support plate 45, which is disposed parallel to, and just above, an upper positioning plate 46 of the supply system 34. Similarly, the grooves in the frame of the second array mechanism are connected by second array tubes to a series of passages extending through a fixed second support plate (not shown), which is disposed parallel to, and just above, the upper positioning plate 46. Outlets of the passages in the first support plate 45 and the second support plate are aligned with bores in the upper positioning plate 46, as will be described more fully below.

Figure 2:
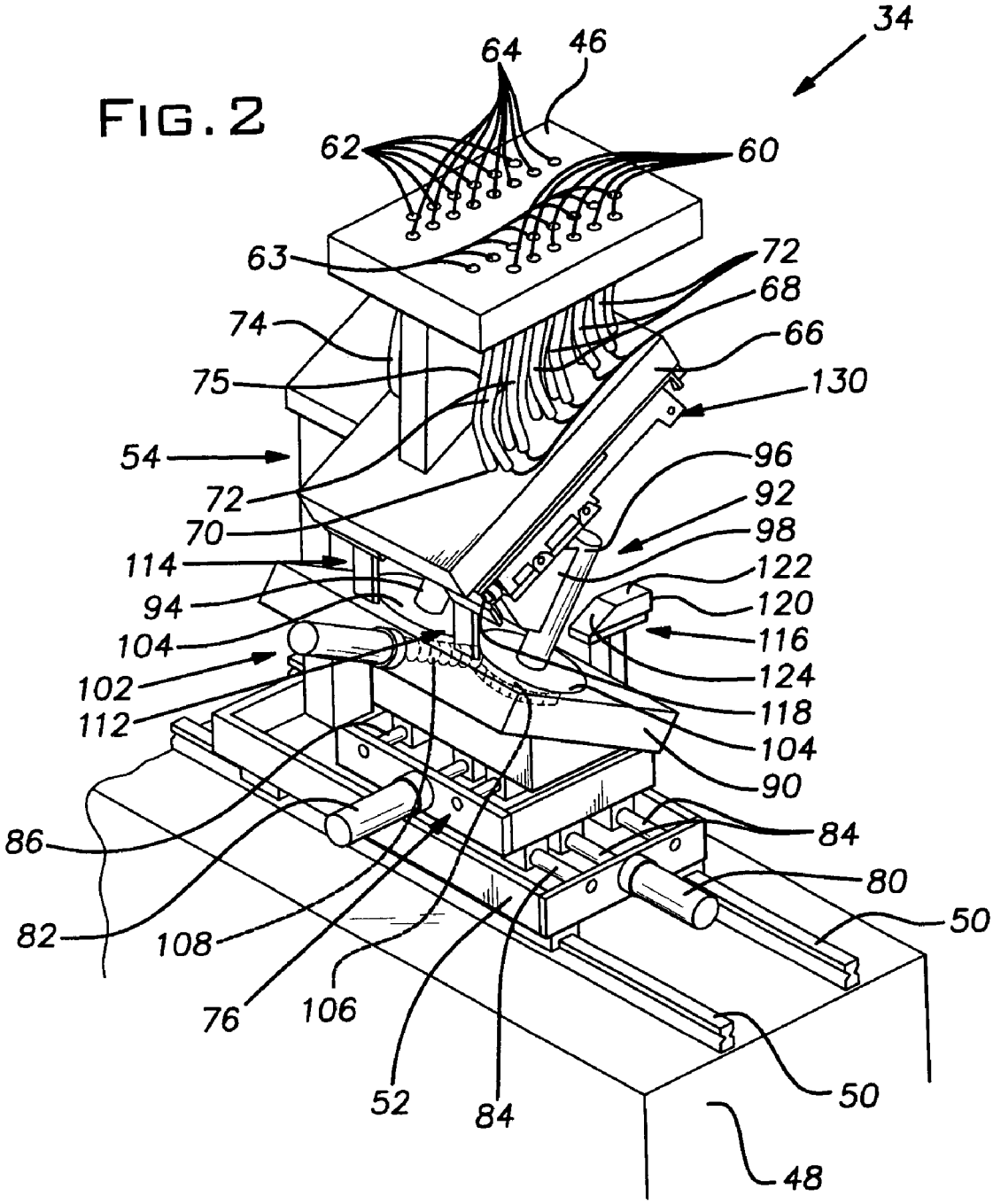
FIG. 2 shows a perspective view of a supply system for the cylinder head pressing system.

The supply system 34 is disposed below the distribution system 32. With reference now to FIG. 2, the supply system 34 includes a base 48 disposed on a floor of the manufacturing facility. A pair of parallel base rails 50 is mounted on an upper surface of the base 48 and extends in a direction normal to the guide press unit 12. A base frame 52 is mounted to the base rails 50 for movement along the length of the base rails 50. A support structure 54 extends vertically upward from the base frame 52 and includes an upper portion to which the upper positioning plate 46 is secured. In this manner, the upper positioning plate 46 is linearly movable with the base frame 52. The upper positioning plate 46 is rectangular and has a planar top surface. A series of spaced-apart first bores 60, a series of spaced-apart second bores 62, a series of spaced-apart third bores 63 and a series of spaced-apart fourth bores 64 are formed in the upper positioning plate 46 and extend therethrough. The series of the first bores 60, the series of the second bores 62, the series of the third bores, 63 and the series of fourth bores 64 are respectively arranged in lines, which are parallel to each other. The series of the third bores 63 are disposed proximate to the series of the first bores 60, while the series of the fourth bores 64 are disposed proximate to the series of the second bores 62. The number of first bores 60 is equal to the number of exhaust valve guide inserts that the first press 24 is operable to insert, namely six, and the number of second bores 62 is equal to the number of intake valve guide inserts that the second press for the intake valve guide inserts is operable to insert, namely six. The number of third bores is equal to the number of exhaust valve guide inserts that the third press is operable to insert, namely eight, and the number of fourth bores is equal to the number of intake valve guide inserts that the fourth press is operable to insert, namely eight.

A lower positioning plate 66 is mounted to the support structure 54, below the upper positioning plate 46. The lower positioning plate 66 is rectangular and is inclined with respect to the horizontal direction. The lower positioning plate 66 has a series of spaced-apart first holes 68, a series of spaced-apart second holes (not shown), a series of spaced-apart third holes 70, and a series of spaced-apart fourth holes (not shown) extending therethrough. The series of the first holes 68, the series of the second holes, the series of the third holes 70 and the series of the fourth holes are respectively arranged in lines, which are parallel to each other. The series of the third holes 70 are disposed proximate to the series of the first holes 68, while the series of the fourth holes are disposed proximate to the series of the second holes. In the series of the first holes 68, the centers of the first holes 68 are separated by spaces equal to the spaces between the centers of the collets 26 of the first press 24 for the exhaust valve guide inserts for the first type of cylinder head, and in the series of the second holes, the centers of the second holes are separated by spaces equal to the spaces between the centers of the collets 26 of the second press for the intake valve guide inserts for the first type of cylinder head. In the series of the third holes 70, the centers of the first holes 68 are separated by spaces equal to the spaces between the centers of the collets 26 of the third press for the exhaust valve guide inserts for the second type of cylinder head, and in the series of the fourth holes, the centers of the fourth holes are separated by spaces equal to the spaces between the centers of the collets 26 of the press for the intake valve guide inserts for the second type of cylinder head. The first bores 60 of the upper positioning plate 46 are connected to the first holes 68 of the lower positioning plate 66 by first tubes 72, and the second bores 62 of the upper positioning plate 46 are connected to the second holes of the lower positioning plate 66 by second tubes 74. The third bores 63 of the upper positioning plate 46 are connected to the third holes 70 of the lower positioning plate 66 by third tubes 75, and the fourth bores 64 of the upper positioning plate 46 are connected to the fourth holes of the lower positioning plate 66 by fourth tubes (not shown).

A body 76 is mounted on the base frame 52 for linear movement in the direction of the guide press unit 12. The body 76 is moved by a first pneumatic cylinder 80 along a set of first guide rails 84. An upper mounting plate 90 is movably mounted to the body 76 and includes an upper surface that is inclined with respect to a horizontal direction. The upper mounting plate 90 is moved in the direction of the guide press unit 12 by a second pneumatic cylinder 82 along a set of second rails 86. First and second arm structures 92, 94 extend upwardly from the upper mounting plate 90. Each of the first and second arm structures 92, 94 includes an arm 98 extending from a rotatable shaft 96 disposed perpendicular to the upper surface of the upper mounting plate 90. The arms 98 of the first and second arm structures 92, 94 include holding plates 100 (shown best in FIG. 6) that are disposed at angles relative to the shafts 96.

The first and second arm structures 92, 94 may be rotated in opposing directions by a drive system 102, which may be of the rack and pinion type. In such a drive system 102, gears 104 are secured to the bottom portions of the shafts 96, respectively, and are enmeshed with each other. A pinion 106 (shown in phantom) is secured to one of the shafts 96, below the gear 104, and is enmeshed with a rack 108 (shown in phantom) that is moved by a pneumatic cylinder 110. Linear movement of the rack 108 causes the gears 104, and, thus, the first and second arm structures 92, 94 to rotate between a return position (shown in FIG. 2), wherein the arms 98 extend rearwardly, away from the guide press unit 12, and a delivery position, wherein the arms 98 extend forwardly, toward the guide press unit 12. More specifically, when the rack 108 is moved rearward, away from the guide press unit 12, the first arm structure 92 rotates counterclockwise to the delivery position and the second arm structure 94 rotates clockwise to the delivery position, whereas when the rack 108 is moved forward, toward the guide press unit 12, the first arm structure 92 rotates clockwise to the return position and the second arm structure 94 rotates counterclockwise to the return position. The incline of the upper mounting plate 90 and the angles at which the arms 98 are disposed relative to the shafts 96 in the first and second arm structures 92, 94 are selected such that the holding plates 100 extend vertically when the first and second arm structures 92, 94 are in the delivery positions.

The supply system 34 further includes a first return cam structure 112, a second return cam structure 114 and a load cam structure 116. As will be described more fully below, the first and second return cam structures 112, 114 and the load cam structure 116 are provided to help actuate release features of a first valve guide holder 130 and a second valve guide holder (not shown) embodied in accordance with the present invention.

The first and second return cam structures 112, 114 are secured to the upper mounting plate 90, behind, and in alignment with, the shafts 96 of the first and second arm structures 92, 94, respectively. Each of the first and second return cam structures 112, 114 includes a head 118 with a top surface and a beveled cam surface. The first and second return cam structures 112, 114 are positioned such that the top surfaces are disposed substantially perpendicular to the holding plates 100 when the first and second arm structures 92, 94 are in the return position, and such that the cam surfaces face the directions in which the first and second arm structures 92, 94 are moving, respectively, when the first and second arm structures 92, 94 are approaching the return positions from the delivery positions. In this manner, the cam surfaces of the first and second return cam structures 92, 94 face outwardly in opposing directions along a line parallel to the base rails 50.

The load cam structure 116 is secured to the base frame 52, in front of the first and second arm structures 92, 94. The load cam structure 116 includes a head 120 with a top surface 122 and a sloping or beveled cam surface 124. The load cam structure 116 is positioned such that the top surface 122 is disposed substantially perpendicular to the holding plates 100 when the first and second arm structures 92, 94 are in the delivery position (i.e., the top surface 122 is positioned horizontally), and such that the cam surface 124 faces the first and second arm structures 92, 94.

The first valve guide holder 130 and the second valve guide holder are provided for holding exhaust valve guide inserts 132 (shown in FIGS. 6-8 ) and intake valve guide inserts (not shown), respectively, for the first type of cylinder head. Thus, the first valve guide holder 130 and the second valve guide holder are adapted to hold six exhaust valve guide inserts 132 and six intake valve guide inserts, respectively. The exhaust valve guide inserts 132 and the intake valve guide inserts are cylindrical and are formed from ferrous sintered metal. A third valve guide holder (not shown) and a fourth valve guide holder (not shown) may also be provided, for future use in the event the operation of the cylinder head pressing system 10 is later changed to insert exhaust valve guide inserts and intake valve guide inserts into the second type of cylinder head. The third and fourth valve guide holders may have substantially the same construction and operation as the first valve guide holder 130 (except for being able to hold eight valve guide inserts instead of six), or less preferably, the third and fourth valve guide holders may have a conventional construction with lock pins. In this regard, it should be noted that the present invention is not limited to holding valve guide inserts (or other parts) of any particular number.

Figure 6:
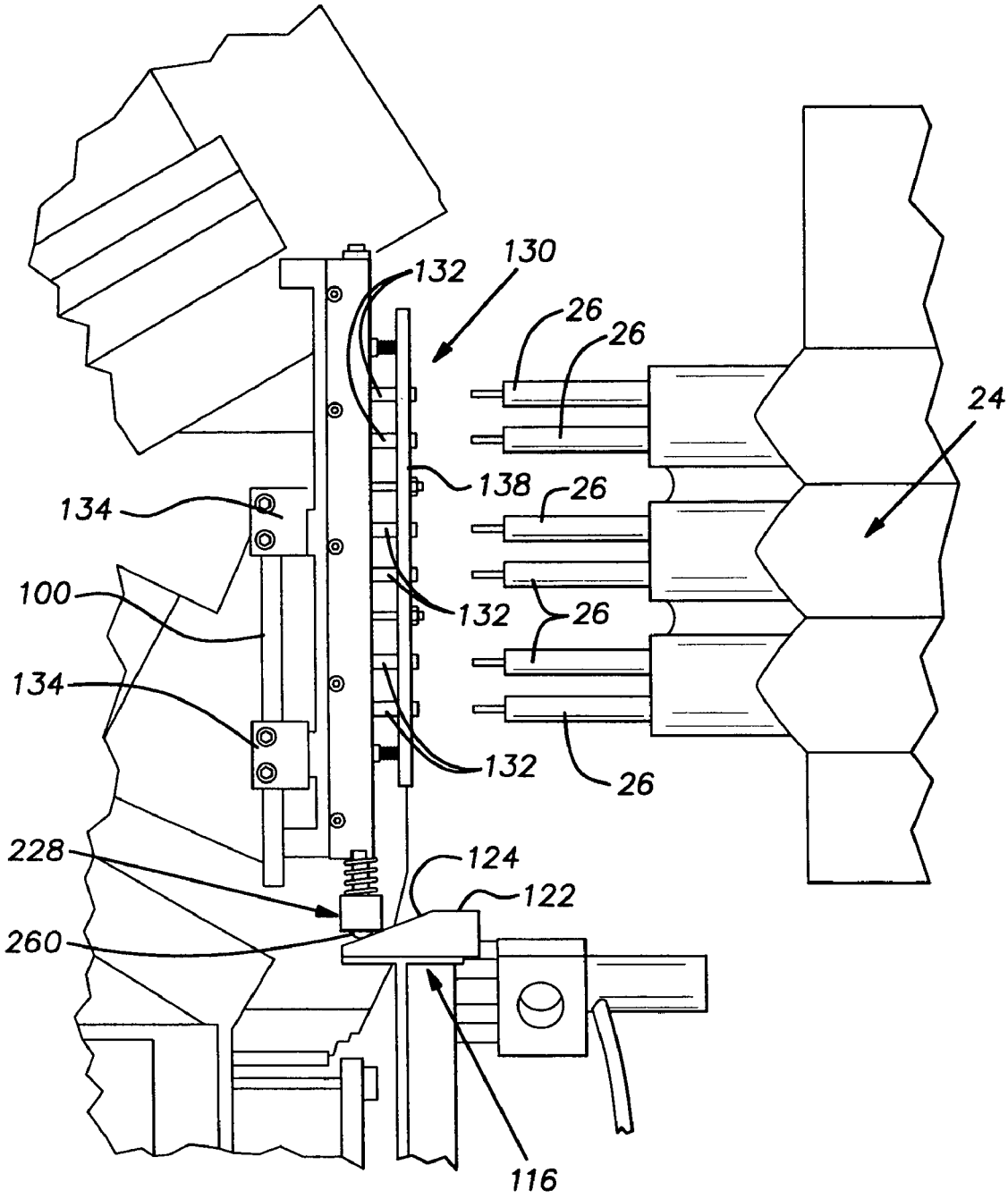
FIG. 6 shows a side view of a portion of the supply system with the valve guide holder and a portion of a press.

The first valve guide holder 130 and the second valve guide holder are secured to the holding plates 100 of the first and second arm structures 92, 94, respectively, by brackets 134 (shown best in FIG. 6). If the third and fourth valve guide holders are provided, the first valve guide holder is secured to the third valve guide holder, which is secured to the holding plate 100 of the first arm structure 92, and the second valve guide holder is secured to the fourth valve guide holder, which is secured to the holding plate 100 of the second arm structure 94.

Figure 3:
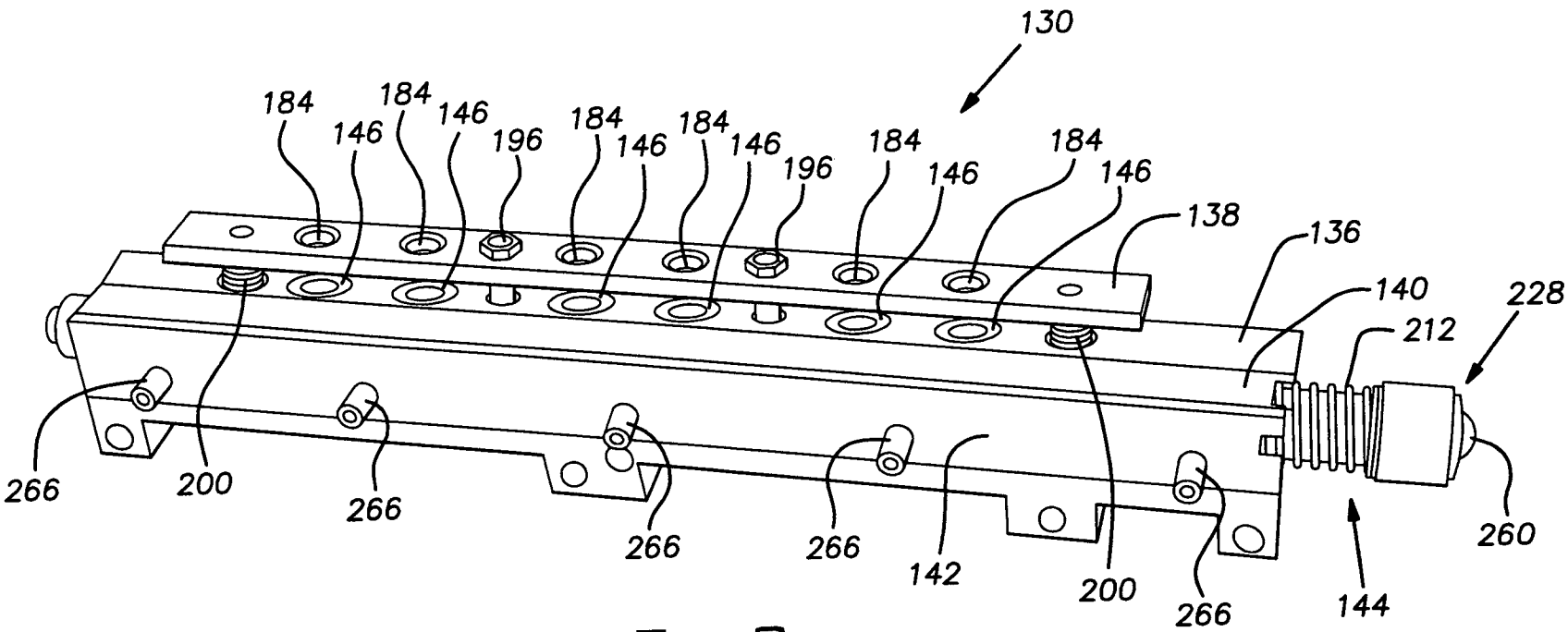
FIG. 3 shows a perspective view of a valve guide holder of the supply system.

With reference now to FIG. 3 and especially FIG. 4, the construction of the first valve guide holder 130 will be described, it being understood that the second valve guide holder has substantially the same structure and operation as the first valve guide holder 130. The first valve guide holder 130 is generally rectangular in shape and generally includes a guide block 136, a guide support plate 138, a bar guide 140, a bar keep 142, a magnetic bar 144, a plurality of guide pockets 146 and a pair of spring pockets 148.

The guide block 136 is generally L-shaped and is preferably composed of aluminum. The guide block 136 includes a top section 150 joined to a bottom section 152 so as to form a ledge or seat 154. The bottom section 152 includes a body 156 with a plurality of legs 158 extending downwardly therefrom. Mounting holes 160 are formed in the legs 158 and extend through front surfaces thereof. The top section 150 includes a top surface 162 and a front surface 164. A plurality of mounting bores 166 extend horizontally into the top section 150 through the front surface 164. A plurality of countersunk bores 168 are vertically disposed in the top section 150 and extend from enlarged openings in the top surface 162 to interiorly-disposed horizontal support surfaces. As will be discussed further below, the countersunk bores 168 are used to hold the exhaust valve guide inserts 132. Accordingly, there are six countersunk bores 168. The centers of the countersunk bores 168 are separated by spaces at least substantially equal to the spaces between the centers of the collets 26 of the press 24. Six smaller diameter securement bores (not shown) communicate with the countersunk bores 168 through openings in the support surfaces. The securement bores extend from the openings in the support surfaces to openings in a bottom surface of the bottom section 152. Front portions of the countersunk bores 168 extend through the front portion so as to form six slots 172. A pair of spring bores 174 and a pair of pin bores 176 also extend vertically through the top section 150. The spring bores 174 extend from openings in the top surface 162 to interiorly-disposed horizontal support surfaces, whereas the pin bores 176 fully extend through the top and bottom sections 150, 152. The spring bores 174 are disposed toward opposing ends of the guide block 136, respectively, and bracket the pin bores 176 and the countersunk bores 168. The pin bores 176 bracket a middle pair of the countersunk bores 168.

Six guide pockets 146 having substantially the same construction are provided, one for each of the countersunk bores 168. Each guide pocket 146 is formed of a ferromagnetic or paramagnetic material. Preferably, each guide pocket 146 is composed of a durable, corrosion-resistant ferromagnetic or paramagnetic metal, such as 304 stainless steel (which is paramagnetic). Each guide pocket 146 includes a substantially annular upper flange 178 joined to a cylindrical body 180. The upper flange 178 has a larger diameter than the body 180 and includes a substantially cylindrical side surface. A portion of the side surface is flat or planar. A smooth cylindrical cavity 182 is formed in each guide pocket 146 and extends vertically from an opening in the upper flange 178 to a concave interior support surface. A threaded bore extends from an opening in a bottom end of the body 180 to an opening in the interior support surface. In each guide pocket 146, the cavity 182 is sized to accommodate an exhaust valve guide insert 132 in a manner such that, absent the presence of any interfering forces, the exhaust valve guide insert 132 is freely movable in and out of the cavity 182.

The spring pockets 148 are cylindrical in shape and define smooth interior cavities 183. Each guide pocket 148 is preferably composed of a durable, corrosion-resistant metal, such as 304 stainless steel.

When the first valve guide holder 130 is fully assembled, such as shown in FIG. 3, the guide pockets 146 are disposed in the countersunk bores 168 of the guide block 136, respectively, and the guide pockets 148 are pressed into the spring bores 174, respectively. The guide pockets 146 are positioned such that the flat portions of the side surfaces of the upper flanges 178 are aligned with the slots 172 in the guide block 136 and the tops of the upper flanges 178 are substantially flush with the top surface 162 of the guide block 136. The guide pockets 146 are secured to the guide block 136 by bolts that extend through the securement bores of the guide block 136 and are threaded into the threaded bores of the guide pockets 146.

The guide support plate 138 is rectangular and is preferably composed of a durable, corrosion-resistant metal, such as 304 stainless steel. Six guide holes 184, a pair of spring holes 186 and a pair of pin holes 188 are formed in the guide support plate 138 and are arranged such that when the guide support plate 138 is mounted to the guide block 136, the guide holes 184, the spring holes 186 and the pin holes 188 of the guide support plate 138 are aligned over the countersunk bores 168, the spring bores 174 and the pin bores 176 of the guide block 136, respectively.

When the first valve guide holder 130 is fully assembled, such as shown in FIG. 3, the guide support plate 138 is movably mounted to the guide is block 136 by a pair of guide pin assemblies 190, each of which includes a guide pin 192 and a bushing 194. The guide pins 192 are movably disposed in the bushings 194, which are removably secured within the pin bores 176 of the guide block 136. The guide pins 192 have threaded top portions that extend through the pin holes 188 in the guide support plate 138 and are threadably received in a pair of nuts 196 disposed exterior to the guide support plate 138, thereby securing the guide pins 192 to the guide support plate 138. A pair of helical springs 200 are pressed into the cavities 183 of the spring pockets 148 and extend between the guide support plate 138 and the guide block 136. In order to maintain proper positioning of the springs 200 relative to the guide support plate 138, a pair of bolts are disposed within the inner diameter of the springs 200 and have their upper ends secured within the spring holes 186 in the guide support plate 138. The guide support plate 138 is movable between an extended postion, wherein the guide support plate 138 is disposed distal to the guide block 136, and a retracted position, wherein the guide support plate 138 is disposed proximate to the guide block 136. In the extended position, the guide support plate 138 is spaced above the guide block 136, whereas in the retracted position, the guide support plate 138 is disposed against or narrowly spaced above the guide block 136. The springs 200 urge the guide support plate 138 toward the extended position. When the exhaust valve guide inserts 132 are disposed in the guide pockets 146 and the guide support plate 138 is in the extended position, the exhaust valve guide inserts 132 extend a small amount above the guide support plate 138. When the guide support plate 138 is in the retracted position, the exhaust valve guide inserts 132 extend a larger amount above the guide support plate 138. In this manner, when the guide support plate 138 is in the extended position, the guide support plate 138 helps to maintain the exhaust valve guide inserts 132 in the first valve guide holder 130, whereas when the guide support plate 138 is in the retracted position, the guide support plate 138 facilitates the removal of the exhaust valve guide inserts 132 from the first valve guide holder 130.

The bar guide 140 and the bar keep 142 cooperate to hold and secure the magnetic bar 144 to the guide block 136. The bar guide 140 is generally channel shaped and is composed of a ferromagnetic or paramagnetic material.

Preferably, the bar guide 140 is composed of a durable, corrosion-resistant ferromagnetic or paramagnetic metal, such as 304 stainless steel. The bar guide 140 includes a center wall 202 joined between outwardly-extending top and bottom walls 204, 206. A plurality of mounting holes (not shown) are formed in the center wall 202 and are arranged so as to be in alignment with the mounting bores 166 in the top section 150 of the guide block 136 when the bar guide 140 is disposed on, and in alignment with, the seat 154 of the guide block 136. A plurality of threaded holes 208 extend horizontally into the bottom wall 206 through an outer end surface thereof. A first end of the bar guide 140 has a circular depression 210 formed therein for seating a spring 212 of the magnetic bar 144, as will be discussed further below.

When the first valve guide holder 130 is fully assembled, such as shown in FIG. 3, the bar guide 140 is disposed on the seat 154 of the guide block 136, with the top and bottom walls 204, 206 extending outwardly and the center wall 202 disposed against the front surfacer 164 of the top section 150. Threaded fasteners extend through the mounting holes in the center wall 202 and are threadably received in the mounting bores 166 in the top section 150, thereby securing the bar guide 140 to the guide block 136. With the bar guide 140 so secured, portions of the bar guide 140 are disposed over and adjacent to or against portions of the guide pockets 146 that are aligned with the slots 172 in the guide block 136.

The bar keep 142 is a rectangular, plate-shaped structure, which is preferably composed of a durable, corrosion-resistant metal, such as 304 stainless steel. The bar keep 142 has interior and exterior surfaces. A channel is formed in the interior surface and extends along the length of the bar keep 142. A plurality of holes 214 extend through a lower portion of the bar keep 142 and are disposed below the channel. A first end of the bar keep 142 has a circular depression 216 formed therein for seating the spring 212 of the magnetic bar 144, as will be discussed further below.

Figure 5:
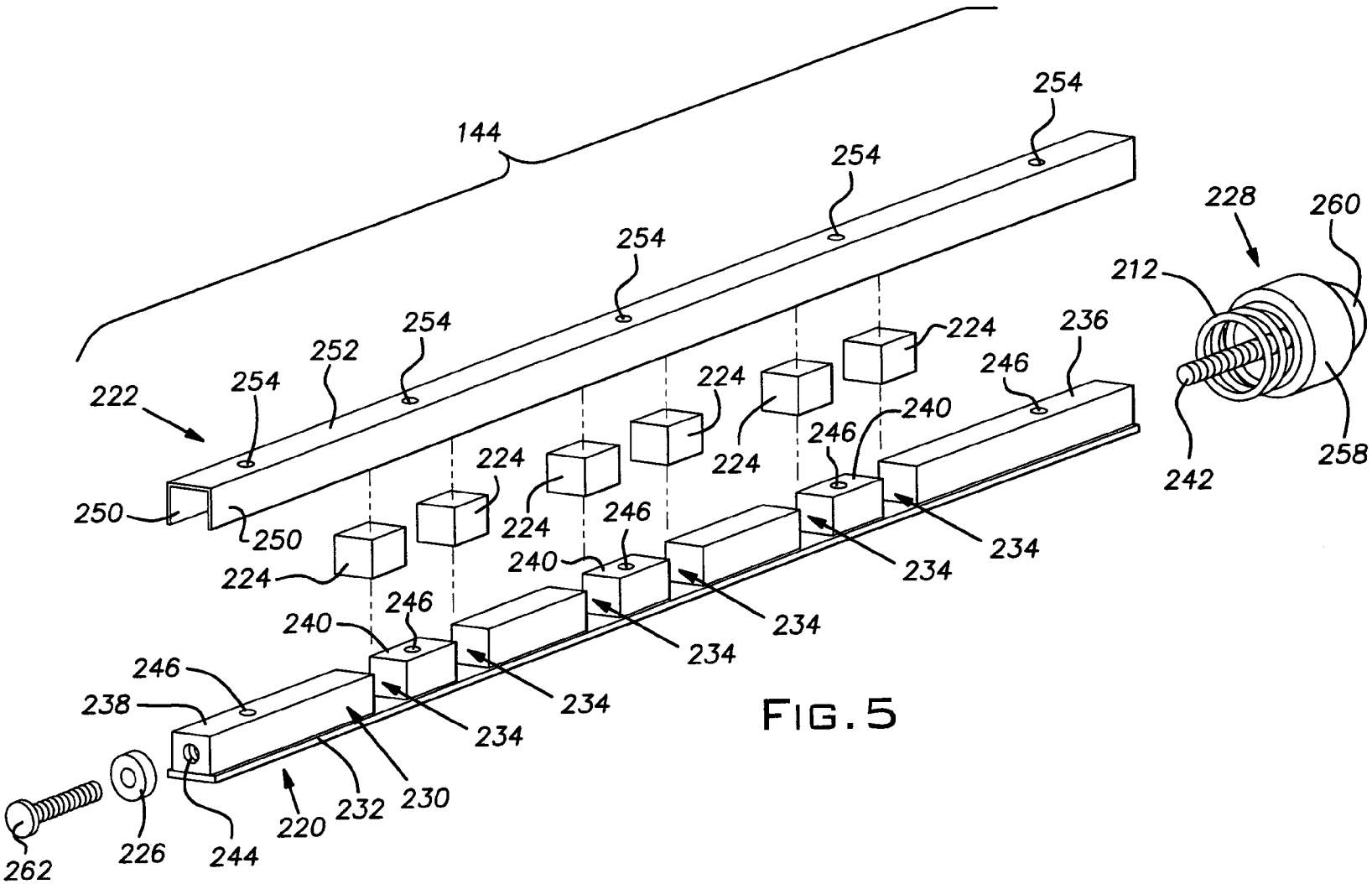
FIG. 5 shows an exploded view of a magnetic bar of the valve guide holder.

Referring now to FIG. 5, there is shown an exploded view of the magnetic bar 144. The magnetic bar 144 generally includes a base 220, a cover 222, a plurality of magnetic bodies 224, an annular end plate 226 and a contact device 228.

The base 220 is composed of a ferromagnetic or paramagnetic material. Preferably, the base 220 is composed of a durable, corrosion-resistant ferromagnetic or paramagnetic metal, such as 304 stainless steel. The base 220 includes a core body 230 joined to a bottom plate 232. The core body 230 is spaced inwardly from side edges of the bottom plate 232 so as to form a pair of longitudinal ledges. A plurality of spaces or cavities 234 are formed in the core body 230. As will be discussed further below, the cavities 234 receive the magnetic bodies 224, wherein there is one magnetic body 224 for each of the exhaust valve guide inserts 132. Accordingly, there are six cavities 234. The centers of the cavities 234 are separated by spaces at least substantially equal to the spaces between the centers of the countersunk bores 168 in the guide block 136. The six cavities 234 divide the core body 230 into a plurality of sections, including first and second end sections 236, 238 and a plurality of mounting sections 240. The first and second end sections 236, 238 have a threaded first bore (not shown) and a threaded second bore 244 extending longitudinally therein, respectively, with openings for the first bore and the second bore 244 being formed in end surfaces of the first and second end sections 236, 238. The first and second end sections 236, 238 and the mounting sections 240 each have a threaded bore 246 extending vertically therein, with openings for the bores 246 being formed in top surfaces of the first and second end sections 236, 238 and the mounting sections 240.

The cover 222 is channel-shaped and is composed of a ferromagnetic or paramagnetic material. Preferably, the cover 222 is composed of a durable, corrosion-resistant ferromagnetic or paramagnetic metal, such as 304 stainless steel. The cover 222 includes a pair of downwardly-extending walls 250 joined between a horizontal center wall 252. A plurality of holes 254 are formed in the center wall 252 and are arranged to be in alignment with the bores 246 in the core body 230 when the cover 22 is aligned over the core body 230.

The contact device 228 includes a cylindrical head 258. A socket is formed in the head and faces laterally outward. A spherical bearing 260 is rotatably held in the socket and extends laterally outward therefrom. The spring 212 is helical and is disposed around the assembled base 220 and cover 222.

The magnetic bodies 224 are composed of a ferrimagnetic material and are permanent magnets. The magnetic bodies 224 are cubical in shape and are sized to fit in the cavities 234 of the core body 230 with minimal gaps being formed between the core body 230 and the magnetic bodies 224.

Figure 4:
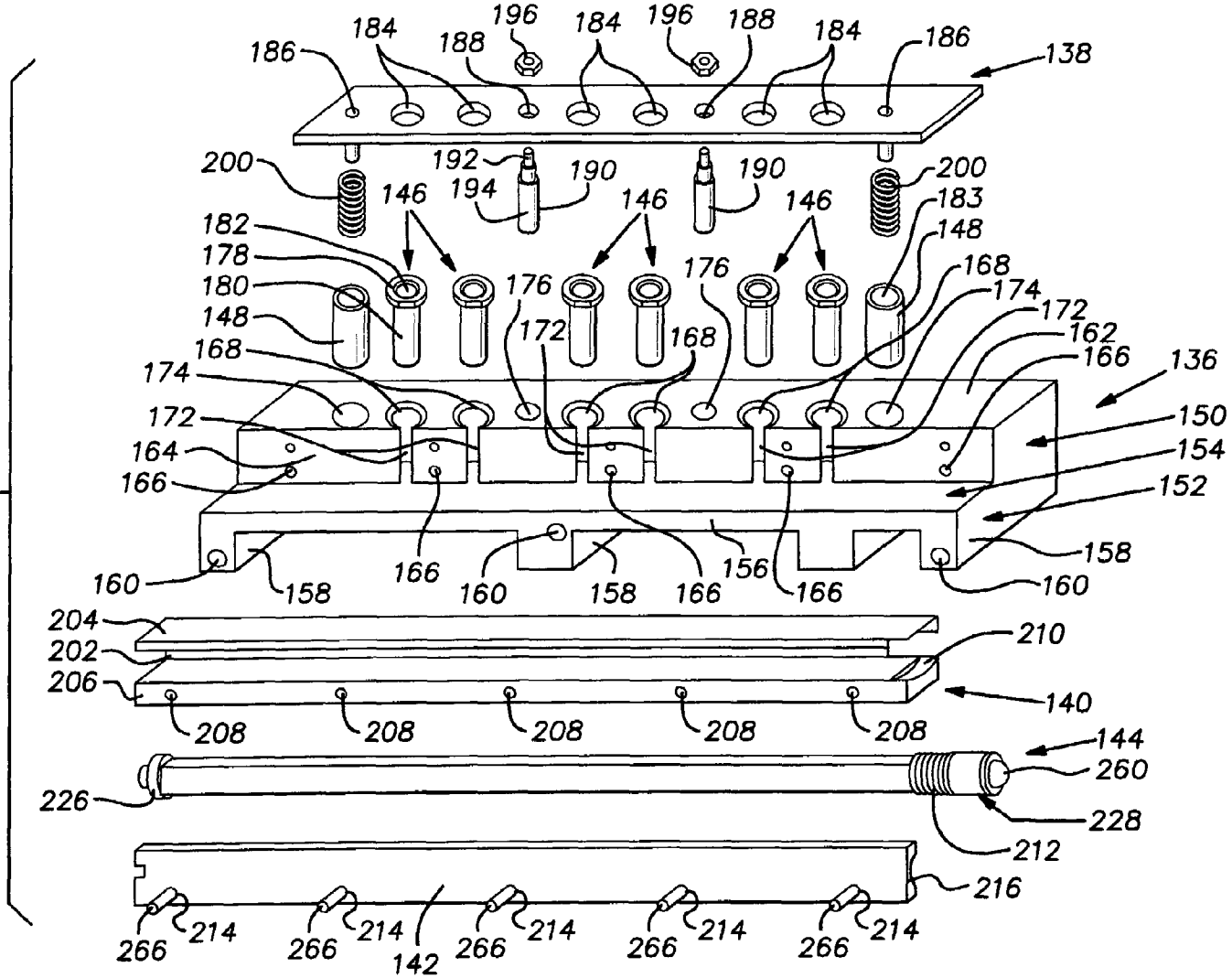
FIG. 4 shows an exploded view of the valve guide holder.

When the magnetic bar 144 is assembled, such as is shown in FIG. 4, the cover 222 is disposed over the core body 230 such that the walls 250 of the cover 222 are supported on the ledges of the bottom plate 232 and the holes 254 in the cover 222 are aligned over the bores 246 in the mounting sections 240 of the core body 230. The cover 222 extends over the spaces so as to form a plurality of voids. The magnetic bodies 224 are disposed in the voids, respectively. The cover 222 is secured to the core body 230 by threaded fasteners (not shown) extending through the holes 254 in the cover 222 and threadably received in the bores 246 of the core body 230. With the cover 222 secured to the core body 230 in this manner, the magnetic bodies 224 are secured from movement in the voids and are arranged such that the centers of the magnetic bodies 224 are separated by spaces at least substantially equal to the spaces between the centers of the countersunk bores 168 in the guide block 136. The contact device 228 is secured to the core body 230 by a threaded fastener 242 extending from the head 258 and threadably received in the first bore in the first end section 236. The end plate 226 is secured to the core body 230 by a threaded fastener 262 extending through an opening in the end plate 226 and threadably received in the second bore 244 in the second end section 238.

When the first valve guide holder 130 is fully assembled, such as shown in FIG. 3, the bar keep 142 is disposed over the bar guide 140, with the magnetic bar 144 disposed in between. The bar keep 142 is positioned such that the channel of the bar keep 142 faces in the direction of an interior surface of the center wall 202 of the bar guide 140. In this manner, the channel of the bar keep 142 and interior surfaces of the center, top and bottom walls 202, 204, 206 of the bar guide 140 cooperate to define a guide passage, within which the magnetic bar 144 is slidably disposed. In addition, the circular depressions 210, 216 in the first ends of the bar guide 140 and the bar keep 142 are aligned and form a spring seat. Threaded fasteners 266 extend through the holes 214 in the bar keep 142 and are threadably received in the holes 208 in the bottom wall 206 of the bar guide 140, thereby securing the bar keep 142 to the bar guide 140 and retaining the magnetic bar 144 in the guide passage.

The end plate 226 of the magnetic bar 144 is disposed exterior to the bar guide 140 and the bar keep 142 and is positioned adjacent to the second ends of the same. The contact device 228 is disposed exterior to the bar guide 140 and the bar keep 142 and is positioned such that the spring 212 extends between the first ends of the bar keep 142 and the bar guide 140 and the head 258 of the contact device 228. More specifically, an inner end of the spring 212 is disposed in the spring seat formed by the bar guide 140 and the bar keep 142 and an outer end of the spring 212 is disposed against the head 258 of the contact device 228. In this manner, the spring 212 applies an outward force against the head 258 of the contact device 228.

With the magnetic bar 144 positioned as described above, the magnetic bar 144 is movable between a first or extended position, wherein the head 258 of the contact device 228 is disposed distal to the first ends of the bar guide 140 and the bar keep 142, and a second or retracted position, wherein the head 258 of the contact device 228 is disposed proximate to the first ends of the bar guide 140 and the bar keep 142. The spring 212 biases or urges the magnetic bar 144 toward the extended position.

Figure 7:
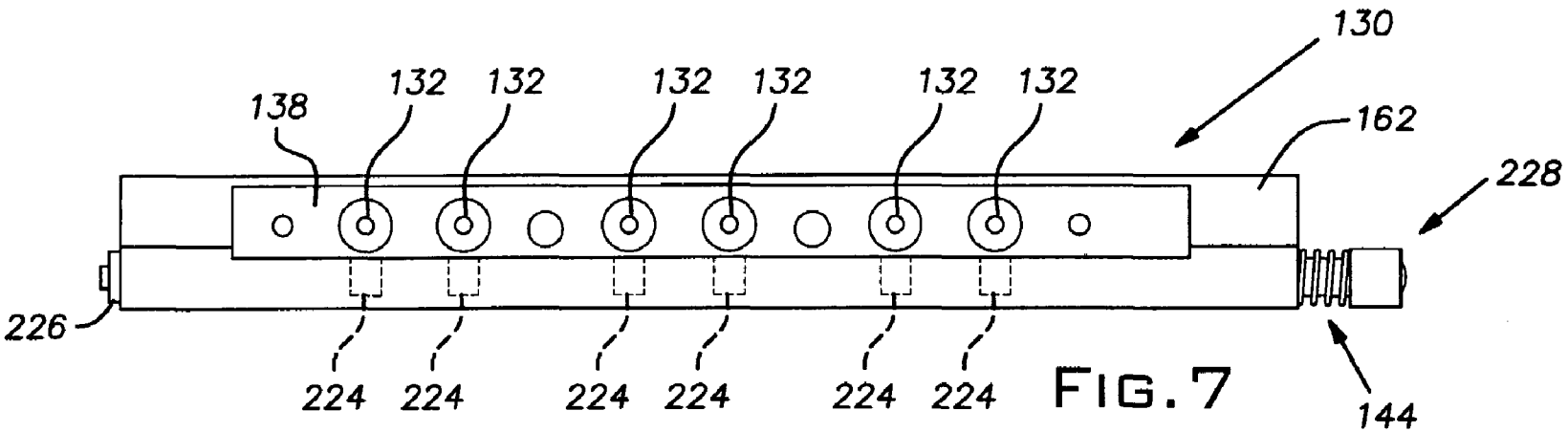
FIG. 7 shows a top view of the valve guide holder with a magnetic bar in an extended position.

Referring now to FIG. 7, the first valve guide holder 130 is shown with the exhaust valve guide inserts 132 disposed in the guide pockets 146 and the magnetic bar 144 in the extended position. The exhaust valve guide inserts 132 are aligned with the magnetic bodies 224 (shown in phantom). The magnetic attraction forces generated by the magnetic bodies 224 are transmitted through the cover 222, the bar guide 140 and the guide pockets 146 to the exhaust valve guide inserts 132 and pull the exhaust valve guide inserts 132 against inner surfaces of the guide pockets 146, thereby holding the exhaust valve guide inserts 132 in the guide pockets 146.

Figure 8:
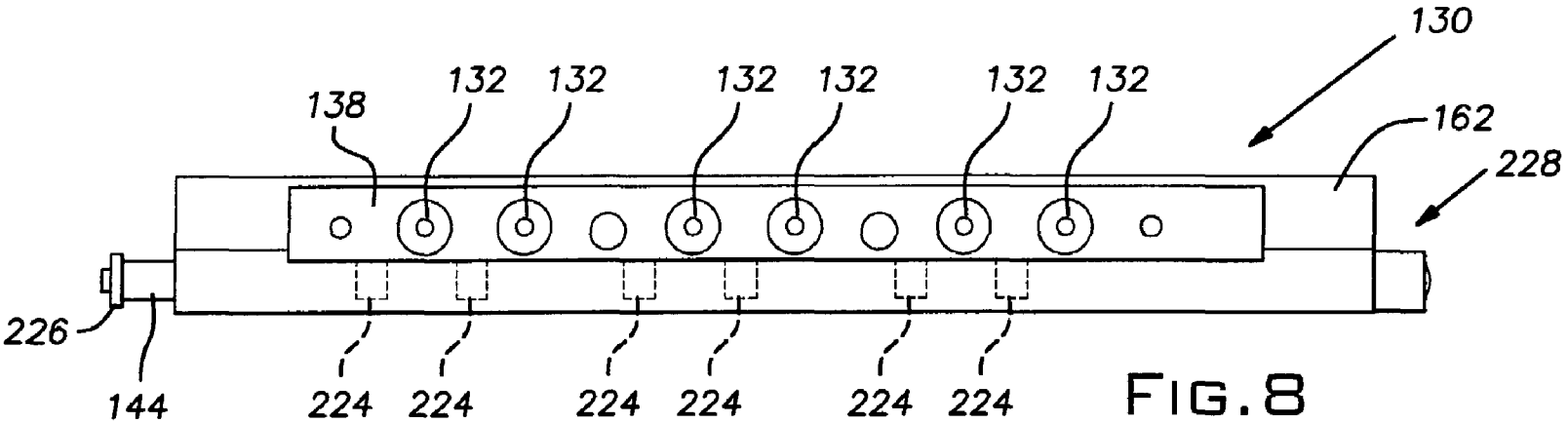
FIG. 8 shows a top view of the valve guide holder with the magnetic bar in a retracted position.

Referring now to FIG. 8, the first valve guide holder 130 is shown with the exhaust valve guide inserts 132 disposed in the guide pockets 146 and the magnetic bar 144 in the retracted position. The exhaust valve guide inserts 132 are not aligned with the magnetic bodies 224 (shown in phantom). Rather, the exhaust valve guide inserts 132 are aligned with sections of the core body 230 and the magnetic bodies 224 are aligned with portions of the top section 150 of the guide block 136. Thus, the magnetic attraction forces generated by the magnetic bodies 224 are not transmitted to the exhaust valve guide inserts 132 and do not pull the exhaust valve guide inserts 132 against inner surfaces of the guide pockets 146. Accordingly, the exhaust valve guide inserts 132 are not held in the guide pockets 146 and are, instead, freely movable out of the guide pockets 146.

The operation of the first valve guide holder 130 and the second valve guide holder in the context of the operation of the cylinder head pressing system 10 will now be described.

The first valve guide holder 130 and the second valve guide holder are secured to the holding plates 100 of the first and second arm structures 92, 94, and the first and second arm structures 92, 94 are in the return positions. The base frame 52 is positioned along the base rails 50 such that the outlets of the passages in the first support plate 45 are aligned with the first bores 60 of the upper positioning plate 46 and the outlets of the passages in the second support plate are aligned with the second bores 62 in the upper positioning plate 46. The contact devices 228 of the first valve guide holder 130 and the second valve guide holder are pressed against the top surfaces of the heads 118 of the first and second return cam structures 112, 114, which causes the magnetic bars 144 to be in their retracted positions.

The first insert feeder 36 and the second insert feeder are supplied in advance with a number of the exhaust valve guide inserts 132 and intake valve guide inserts, respectively. When the first insert feeder 36 and the second insert feeder are actuated, the exhaust valve guide inserts 132 are successively fed via the first tubes 40 into the first array mechanism 42 and the intake valve guide inserts are successively fed via the second tubes into the second array mechanism. Six exhaust valve guide inserts 132 enter the first array mechanism 42 and then are moved by the distributor therein into the grooves, while six intake valve guide inserts enter the second array mechanism and then are moved by the distributor therein into the grooves. The six exhaust valve guide inserts 132 and the six intake valve guide inserts move from the grooves through the first array tubes 44 and the second array tubes to the passages in the first support plate 45 and the second support plate, respectively. The six exhaust valve guide inserts 132 drop into the first bores 60 of the upper positioning plate 46 from the outlets of the passages in the first support plate 45 and then travel through the first tubes 72 to the first holes 68 of the lower positioning plate 66. The six intake valve guide inserts drop into the second bores 62 of the upper positioning plate 46 from the outlets of the passages in the second support plate and then travel through the second tubes 74 to the second holes of the lower positioning plate 66. The six exhaust valve guide inserts 132 drop from the first holes 68 in the lower positioning plate 66 into the cavities 182 in the guide pockets 146 in the first valve guide holder 130, while the six intake valve guide inserts drop from the second holes in the lower positioning plate 66 into the cavities 182 in the guide pockets 146 in the second valve guide holder. Since the magnetic bars 144 are in their retracted positions, the exhaust valve guide inserts 132 and the intake valve guide inserts freely enter the cavities 182 in the guide pockets 146.

After the exhaust valve guide inserts 132 and the intake valve guide inserts have been supplied to the first valve guide holder 130 and the second valve guide holder, respectively, the drive system 102 is actuated to move (rotate) the first and second arm structures 92, 94 to the delivery positions. As the first arm structure 92 rotates counterclockwise and the second arm structure 94 rotates clockwise, the bearings 260 of the contact devices 228 roll down the cam surfaces of the first return cam structure 112 and the second return cam structure 114, respectively, and the magnetic bars 144 move to the extended positions under the bias of the springs 212. When the magnetic bars 144 are in the extended positions, the magnetic bodies 224 in the first valve guide holder 130 and the second valve guide holder are aligned with the exhaust valve guide inserts 132 and the intake valve guide inserts, respectively, which causes the exhaust valve guide inserts 132 to be securely held in the guide pockets 146 of the first valve guide holder 130 and the intake valve guide inserts to be securely held in the guide pockets 146 of the second valve guide holder, as described above. With the exhaust valve guide inserts 132 and the intake valve guide inserts securely held in the foregoing manner, the first and second arm structures 92, 94 continue their rotation to the delivery positions.

When the first and second arm structures 92, 94 are at the delivery positions, the first valve guide holder 130 and the second valve guide holder are vertically disposed and the first valve guide holder 130 is aligned with the load cam structure 116 and the press 24. The cam surface 124 of the load cam structure 116 is disposed at an acute angle to the magnetic bar 144 and the contact device 228. The upper mounting plate 90 is then moved linearly forward, toward the press 24, which causes the bearing 260 of the contact device 228 to roll up the cam surface 124. The movement of the contact device 228 up the cam surface 124 and onto the top surface 122 moves the magnetic bar 144 to the retracted position, which causes the exhaust valve guide inserts 132 to become loosely disposed in the guide pockets 146 of the first valve guide holder 130, thereby permitting the exhaust valve guide inserts 132 to be facilely removed. With the magnetic bar 144 in the retracted position, the upper mounting plate 90 continues to move forward such that free end portions of the collets 26 of the press 24 move into openings in the exhaust valve guide inserts 132. As the upper mounting plate 90 continues to move forward, inward portions of the collets 26 contact the guide support plate 138 and move the guide support plate 138 to the retracted position. At this point, the first arm structure 92 is in a load position and the exhaust valve guide inserts 132 are pressed onto the collets 26. The upper mounting plate 90 then moves rearward, which causes the first valve guide holder 130 to move away from the press 24 and leave the exhaust valve guide inserts 132 on the collets 26. In this manner, the exhaust valve guide inserts 132 are removed from the guide pockets 146 and deposited on the collets 26 of the press 24.

After the first and second arm structures 92, 94 return to the delivery positions, the turret 22 rotates 180° to present the second press for receiving the intake valve guide inserts. The body 76 then moves normal to the second press so that the second valve guide holder is aligned with the load cam structure 116 and the second press. The upper mounting plate 90 is again moved forward to move the second arm structure to a load position, wherein the intake valve guide inserts are pressed onto the collets 26 of the second press. In moving from the delivery position to the load position, the second valve guide holder operates in substantially the same manner as the first valve guide holder 130. After the intake valve guide inserts are pressed on the collets 26 of the press, the upper mounting plate 90 and, thus, the second arm structure 94 move rearwardly, thereby removing the intake valve guide inserts from the guide pockets 146 and depositing them on the collets 26 of the press. The movement of the first and second arm structures 92, 94 back to the delivery positions causes the magnetic bars 144 to move to the extended positions.

After the exhaust valve guide inserts 132 and the intake valve guide inserts have been transferred to the guide press unit 12, as described above, the drive system 102 is actuated to move (rotate) the first and second arm structures 92, 94 to the return positions, with the first arm structure 92 rotating clockwise and the second arm structure 94 rotating counterclockwise. As the first and second arm structures 92, 94 approach the return positions, the bearings 260 of the contact device 228 roll up the cam surfaces of the first and second return cam structures 112, 114, respectively, and onto the top surfaces thereof, thereby moving the magnetic bars 144 to the retracted positions against the bias of the springs 212. With the first and second arm structures 92, 94 in the return positions and the magnetic bars 144 of the first valve guide holder 130 and the second valve guide holder in the retracted positions, another six exhaust valve guide inserts 132 and another six intake valve guide inserts may be freely deposited in the cavities 182 of the guide pockets 146 of the first valve guide holder 130 and the second valve guide holder, respectively, and the foregoing operation may be repeated.

In the event the third and fourth valve guide holders are provided and secured to the first valve guide holder 130 and the second valve guide holder (as described above) and the operation of the cylinder head pressing system 10 is modified to insert valve guide inserts into the second type of cylinder head, the base frame 52 is initially moved along the base rails 50 such that the outlets of the passages in the first support plate 45 are aligned with the third bores 63 of the upper positioning plate 46 and the outlets of the passages in the second support plate are aligned with the fourth bores 64 in the upper positioning plate 46. In this manner, when the first insert feeder 36 and the second insert feeder are actuated, eight exhaust valve guide inserts drop into the third bores 63 of the upper positioning plate 46 from the outlets of the passages in the first support plate 45 and then travel through the third tubes 75 to the third holes 70 of the lower positioning plate 66. In addition, eight intake valve guide inserts drop into the fourth bores 64 of the upper positioning plate 46 from the outlets of the passages in the second support plate and then travel through the fourth tubes to the fourth holes of the lower positioning plate 66. If the third and fourth valve guide holders have substantially the same construction and operation as the first valve guide holder 130 (except for being able to hold eight valve guide inserts), the eight exhaust valve guide inserts drop from the third holes 70 in the lower positioning plate 66 into the cavities 182 in the guide pockets 146 in the third valve guide holder, while the eight intake valve guide inserts drop from the fourth holes in the lower positioning plate 66 into the cavities 182 in the guide pockets 146 in the fourth valve guide holder. Since the magnetic bars 144 of the third and fourth valve guide holders are in their retracted positions, the exhaust valve guide inserts and the intake valve guide inserts freely enter the cavities 182 in the guide pockets 146. The supply system 34 is then operated in the same manner as described above with regard to the first valve guide holder 130 and the second valve guide holder, except the exhaust valve guide inserts are transferred to the third press and the intake valve guide inserts are transferred to the fourth press.

As can be appreciated from the foregoing description, the valve guide holder of the present invention (e.g. the first valve guide holder 130) provides benefits over conventional valve guide holders with locking pins. Since the valve guide holder of the present invention utilizes magnetic attraction forces to hold valve guide inserts, there are no mechanical holding devices (such as spring-biased locking pins) that can become fouled with debris and malfunction. In addition, the guide passage within which the magnetic bar 144 is disposed is physically isolated from the valve guide inserts. Thus, it is difficult for debris from the valve guide inserts to enter the guide passage and interfere with the movement or operation of the magnetic bar 144. Moreover, even if debris from the valve guide inserts was able to enter the guide passage, the debris would most likely be ferromagnetic and would not interfere with the conveyance of the magnetic attraction forces. Accordingly, it is difficult for debris to interfere with the operation of the valve guide holder of the present invention.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A holding device for holding a plurality of ferromagnetic parts, said holding device comprising:

a holder defining a plurality of cavities within which the parts may be disposed, said cavities being spaced apart and arranged in a row; and a bar movably mounted to the holder and disposed parallel to the row of the cavities, said bar including a plurality of spaced-apart magnetic bodies arranged in a row, said bar being movable in the direction of the row of the cavities between first and second positions, wherein when the parts are disposed in the cavities and the bar is in the first position, the magnetic bodies are aligned with the cavities and the magnetic attraction forces generated by the magnetic bodies hold the parts in the cavities, and wherein when the parts are disposed in the cavities and the bar is in the second position, the magnetic bodies are not aligned with the cavities and the magnetic attraction forces generated by the magnetic bodies do not hold the parts in the cavities, wherein when the parts are disposed in the cavities and the bar is in the first position, portions of the holder are aligned with the magnetic bodies and area disposed between the magnetic bodies and the parts, said portions being composed of a ferromagnetic or a paramagnetic material, wherein the holder comprises a holding structure having a plurality of bores formed therein and a plurality of guide pockets disposed in the bores, said guide pockets defining the cavities, wherein the bores in the holding structure extend through a surface of the holding structures so as to form a plurality of slots in the holding structure that extend along the length of the bores.

2. The holding device of claim 1, wherein the holder further comprises a bar guide and a bar keep that cooperate to define a guide passage within which the bar is slidably disposed, and wherein the bar guide is secured to the holding structure, over the slots in the holding structure.

3. The holding device of claim 2, wherein when the bar is in the first position, the magnetic bodies are aligned with the slots in the holding structure, respectively.

4. The holding device of claim 3, wherein the guide pockets and the bar guide are composed of paramagnetic material.

5. The holding device of claim 4, wherein the holding structure is composed of paramagnetic material.

6. The holding device of claim 5, wherein the holding structure is composed of aluminum and the guide pockets and the bar guide are composed of stainless steel.

7. A holding device for holding a plurality of ferromagnetic parts, said holding device comprising:

a holder defining a plurality of cavities within which the parts may be disposed, said cavities being spaced apart and arranged in a row; and a bar movably mounted to the holder and disposed parallel to the row of the cavities, said bar including a plurality of spaced-apart magnetic bodies arranged in a row, said bar being movable in the direction of the row of the cavities between first and second positions, wherein when the parts are disposed in the cavities and the bar is in the first position, the magnetic bodies are aligned with the cavities and the magnetic attraction forces generated by the magnetic bodies hold the parts in the cavities, and when the parts are disposed in the cavities and the bar is in the second position, the magnetic bodies are not aligned with the cavities and the magnetic attraction forces generated by the magnetic bodies do not hold the parts in the cavities, wherein the bar further comprises an elongated base and an elongated cover, the base and the cover being composed of paramagnetic material, that cooperate to define a plurality of voids within the magnetic bodies are disposed, wherein the bar further comprises a contact device secured to an end portion of the base, said contact device comprising a head defining a socket that rotatably holds a spherical bearing.

8. The holding device of claim 7, wherein the holding device further comprises a spring disposed between the holder and the contact device, said spring biasing the bar to the first position.

9. A supply system for supplying a plurality of ferromagnetic parts to an installing device, said supply system comprising:

(a.) a mounting structure movable between a return position and a load position;

(b.) a holding device connected to the mounting structure for movement therewith, said holding device comprising:

a holder defining a plurality of cavities within which the parts may be disposed, said cavities being spaced apart and arranged in a row;

a bar movably mounted to the holder and disposed parallel to the row of the cavities, said bar including a plurality of spaced-apart magnetic bodies arranged in a row, said bar being movable in the direction of the row of the cavities between first and second positions, wherein when the parts are disposed in the cavities and the bar is in the first position, the magnetic bodies are aligned with the cavities and the magnetic attraction forces generated by the magnetic bodies hold the parts in the cavities, and wherein when the parts are disposed in the cavities and the bar is in the second position, the magnetic bodies are not aligned with the cavities and the magnetic attraction forces generated by the magnetic bodies do not hold the parts in the cavities; and (c.) at least one actuation structure positioned such that an end portion of the bar contacts the at least one actuation structure during the movement of the mounting structure between the return position and the load position, wherein such contact between the at least one actuation structure and the end portion of the bar moves the bar to the second position.

10. The supply system of claim 9, wherein the holding device further comprises a spring that biases the bar to the first position.

11. The supply system of claim 10, wherein when the mounting structure is in the return position, the holder of the holding device is positioned to receive parts in the cavities, and wherein when the mounting structure is in the load position, the holder of the holding device is position to deliver the parts to the installing device.

12. The supply system of claim 11, wherein the at least one actuation structure comprises a return cam structure and a load cam structure, wherein the return cam structure is positioned to contact the end portion of the bar as the mounting structure is approaching the return position from the load position, and wherein the load cam structure is positioned to contact the end portion of the bar as the mounting structure is approaching the load position from the return position, whereby the bar is in the second position when the mounting structure is in the return position and when the mounting structure is in the load position.

13. The supply system of claim 12, wherein the during the travel of the holding device between the return cam structure and the load cam structure, the bar is in the first position.

14. The supply system of claim 12, wherein the end portion of the bar that contacts the return cam structure and the load cam structure comprises a rotatable bearing.

15. The supply system of claim 14, wherein the load cam structure and the return cam structure each comprises a cam surface positioned at an acute angle to the end portion of the bar when the end portion contacts the cam surface.

16. The supply system of claim 9, wherein the holder comprises a holding structure having a plurality of bores formed therein and a plurality of pockets disposed in the bores, said pockets defining the cavities.

17. The supply system of claim 16, wherein the holding structure is composed of a paramagnetic metal and the pockets are composed of a paramagnetic metal.

18. The supply system of claim 17, wherein the holding structure is composed of aluminum and the pockets are composed of stainless steel.

19. The supply system of claim 9, wherein the magnetic bodies comprise permanent magnets.

* * * * *

UNITED STATES PATENT AND TRADEMARK OFFICE

CERTIFICATE OF CORRECTION

PATENT NO. : 7,275,294 B1
APPLICATION NO. : 10/647954
DATED : October 2, 2007
INVENTOR(S) : Okuley It is certified that error appears in the above-identified patent and that said Letters Patent is hereby corrected as shown below:

On the title page, Section [56] References Cited, U.S. Patent Documents, 13th reference, delete "2,754,313" and insert --3,754,313--.

Column 16, Line 3, (Claim 1, Line 22), delete "area" and insert --are--.

Column 16, Line 45, (Claim 7, Line 15), after "and" insert --wherein--.

Column 17, Line 36, (Claim 11, Line 5), delete "position" and insert --positioned--.

Column 18, Line 12, (Claim 13, Line 1), delete "the" (second occurrence).

Signed and Sealed this

Twenty-seventh Day of November, 2007

JON W. DUDAS
*Director of the United States Patent and Trademark Office*